United States Patent [19]

Kaiser

[11] 4,219,340

[45] Aug. 26, 1980

[54] METHOD AND APPARATUS FOR OUTFLOWING LIQUIDS FROM CHAMBER MAINTAINED UNDER VACUUM

[75] Inventor: Robert G. Kaiser, Seminole, Fla.

[73] Assignee: Clark & Vicario Corporation, St. Petersburg, Fla.

[21] Appl. No.: 969,323

[22] Filed: Dec. 14, 1978

[51] Int. Cl.[2] ..... B01D 19/00

[52] U.S. Cl. ..... 55/41; 55/55; 406/168

[58] Field of Search ..... 209/211; 210/512; 55/41, 190 R, 199; 406/168, 175

[56] References Cited

U.S. PATENT DOCUMENTS

| | | | |
|---|---|---|---|
| 2,967,618 | 1/1961 | Vane | 210/512 X |
| 3,421,622 | 1/1969 | Wurtmann | 55/41 |
| 3,432,036 | 3/1969 | Kaiser | 55/41 X |
| 3,538,680 | 11/1970 | Kaiser | 55/41 |

*Primary Examiner*—Charles N. Hart
*Assistant Examiner*—E. Rollins Cross
*Attorney, Agent, or Firm*—Watson, Leavenworth, Kelton & Taggart

[57] ABSTRACT

Outflow of liquid from an elevated chamber maintained under a condition of vacuum which outflow is delivered through a dropleg conduit to a point of use at a lower level is effected by establishing a plurality of outflow courses in an upper length portion of the dropleg conduit with entry to such outflow courses being arranged at different elevations within the chamber so that flow through an outflow course cannot occur before first there occurs the filling of outflow courses having entry elevations below the said particular outflow course.

34 Claims, 19 Drawing Figures

FIG. 13
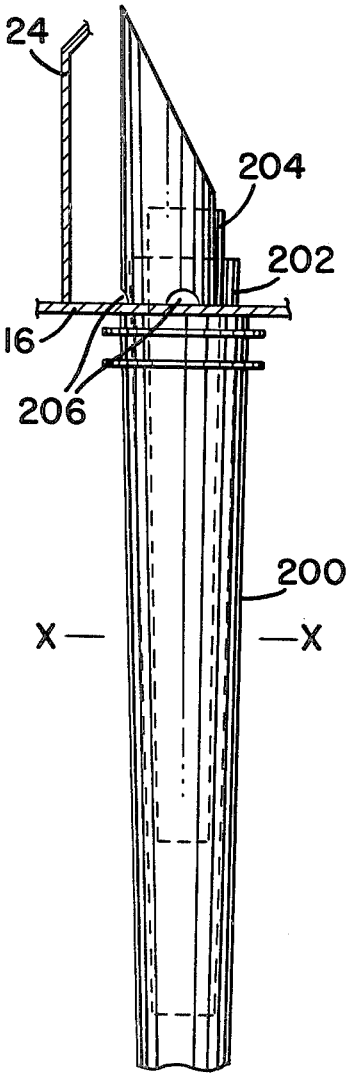
FIG. 14
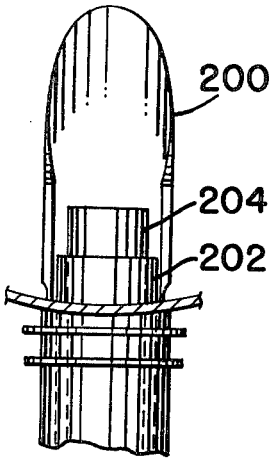
FIG. 15a
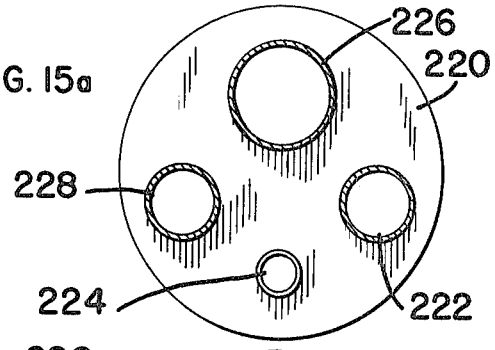
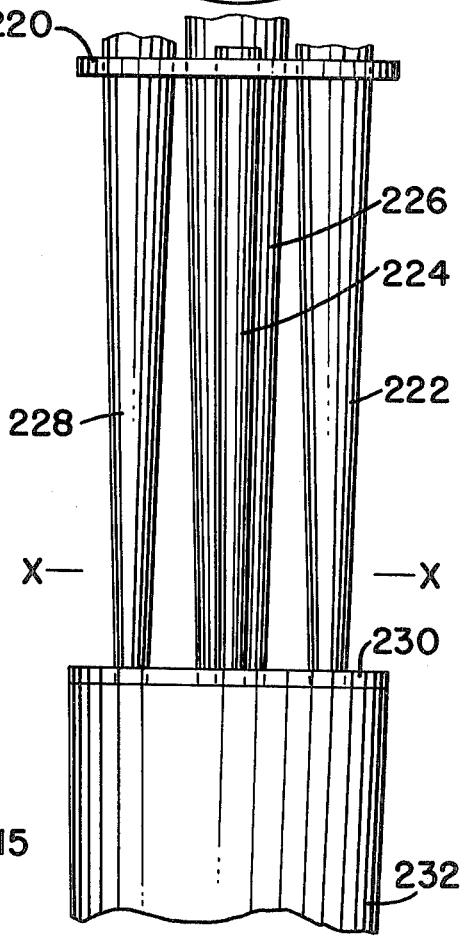
FIG. 15
FIG. 15b
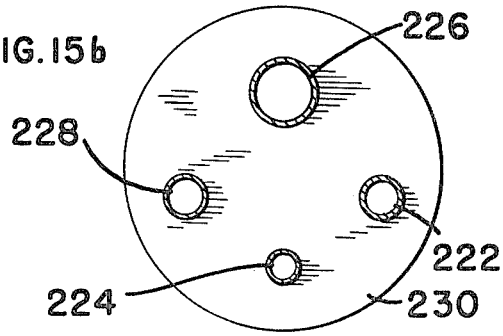

METHOD AND APPARATUS FOR OUTFLOWING LIQUIDS FROM CHAMBER MAINTAINED UNDER VACUUM

BACKGROUND OF THE INVENTION

In certain industrial operations it is known to collect liquid at an elevated location and return it by means of a barometric dropleg conduit means to a point of use located some distance below the elevated location. An example of one such operation is in papermaking apparatus involving a cleaner system wherein a portion of cleaned, deaerated papermaking stock is conveyed from an elevated chamber maintained under vacuum back to a wire pit or silo or alternatively to the suction side of a pump drawing dilution water from the silo for delivery of such dilution water to a cleaning stage operation. U.S. Pat. Nos. 3,206,917 and 3,770,315 are exemplary of such apparatus, system and particular liquid return operation except that the point of use for liquid return disclosed in said patent is to the suction side of a cleaning stage feed pump rather than to the wire pit.

It has been found that where papermaking suspension overflow from the elevated stock receiver which overflow passes over a weir in the stock receiver, is conveyed back to the wire pit or pump suction side in a barometric dropleg conduit, undesirable vibration, pulsation, noise and the like may be produced in the dropleg conduit which conditions could be detrimental to the achievement of optimized operating performance of the overall papermaking system.

SUMMARY OF THE PRESENT INVENTION

The present invention is concerned generally with improved apparatus and method for collecting and returning a liquid from an elevated collection point maintained under condition of vacuum through a barometric dropleg conduit means to a point of use location below the collection point and in such manner as substantially eliminates the likelihood of creation of any pulsation, vibration, noise and the like in the dropleg conduit. In a particular embodiment, the invention is described in terms of its applicability to the handling of papermaking suspension in papermaking apparatus. However, it will be readily understood that the invention is applicable to the handling of other liquids under conditions similar to those found in the papermaking system, i.e., use of vacuum and employment of a barometric dropleg return conduit.

In accordance with the present invention, a liquid being introduced into and collected in an elevated receiver and subjected therein to a deaerating condition of vacuum, is returned by means of a barometric dropleg conduit means to a point of use some distance below the receiver. As will be understood and appreciated, the conveyance operation, operating capacity range of, e.g., the papermaking system, and the concomitant dropleg conduit size have been such that the dropleg conduit would never run full, although the condition of vacuum and temperature of the liquid exert a vacuum lift on the liquid in the dropleg conduit and maintain a level of the liquid a certain distance above the point of use. In consequence, liquid outflow from the receiver to the dropleg conduit has generally been in the nature of a cascading free fall which could produce the likelihood of creation of undesirable pulsations as the liquid freely falling in the dropleg conduit impinges or strikes the vacuum lifted level therein. To overcome this and as the invention provides, there is established in at least an upper length portion of the dropleg conduit means a plurality of separate outflow courses which extend downwardly a distance below the minimum vacuum lift level in the conduit while maintaining the flow entry to the respective outflow courses at different levels of elevation so that outflow through any outflow course can occur only subsequent to the substantially complete filling of outflow courses having flow entry levels below that of said given outflow course. The flow entry levels to the respective outflow courses thus vary upwardly at different lengths from the bottom of the receiver. Conveniently, the plurality of outflow courses is established by employment of a plurality of pipes in and as the upper length portion of the dropleg conduit means, such pipes extending down below the minimum liquid suction lift level by at least a distance of 12 inches and upwardly, for some of the pipes, a distance within the receiver.

The arrangement of the plurality of pipes can be effected to provide varying flow entry levels in a number of ways. The flow entry level could be that of the top edge of the pipe or alternatively entry notches could be formed in the side wall structure of the pipes, such notches all being at a common side of the pipes and at a location which is remote from the point of entry of the liquid to the collection space of the receiver. In this manner cascade flow into the space is caused to strike against the pipes and divert in a flow around path in the chamber before finding outflow entry to the pipes and at which point smooth uniform outflow to an outflow course can ensue. It will be understood that desirably for at least one pipe in the plurality, the flow entry thereto will be at the bottom of the receiver.

The plurality of pipes can be provided and disposed in various manners. They can, for example, be a concentrically arranged array of such pipes, (each pipe with an adjacent one defining an annular outflow course), a clustered together arrangement of pipes or a spaced apart arrangement.

The pipes can be of varying cross-section including circular, square, hexagon, wedge or other shape and also may be arranged in cluster with a center pipe and the remainder in circulary spaced array around the center pipe.

The pipes also can be tapered for at least a portion of their lengths from top to bottom to thereby create a flow velocity increase in the liquid flowing through the pipes. Further, means can be provided to fit extension pieces to the tops of the pipes thereby to increase the height above the receiver bottom.

Where employed in a papermaking system, the space in which the liquid collects can be an overflow chamber in a stock receiver in which a weir or like level control is maintaining a pond of deaerated papermaking stock, the stock overflowing from the weir being that returned to the point of use, i.e., to a wire pit or silo, or alternatively the suction side of a pump drawing liquid from the wire pit.

BRIEF DESCRIPTION OF THE DRAWINGS

Other objects of the invention will in part be obvious and will in part appear from the following detailed description taken in conjunction with the accompanying drawings wherein like reference numerals identify like parts throughout, and in which:

FIG. 13 is a side elevational view of still another embodiment of dropleg conduit means upper length portion and depicting the employment of drain holes in the outermost pipe in a concentric plurality of such pipes.

FIG. 14 is a front elevational view of the upper portion of FIG. 13.

FIG. 15 is a front elevational view depicting the employment of a plurality of pipes of tapering section employed to increase velocity flow through such pipes, the pipes being shown joined together at their upper and lower parts by means of connector plate structure.

FIGS. 15*a* and 15*b* depict respective top and bottom views of the pipe arrangement shown in FIG. 15 and particularly illustrating the reduction in size of said pipes between their respective inlet and outlet ends.

DESCRIPTION OF THE PREFERRED EMBODIMENTS

The present invention will be described below in terms of the employment of both the apparatus and method of the invention as utilized in a papermaking system. However, it will be understood that it is equally applicable to other industrial operations in which a liquid is to be collected and conveyed from a higher to lower location under conditions analogous to those to be described.

Figure 1:
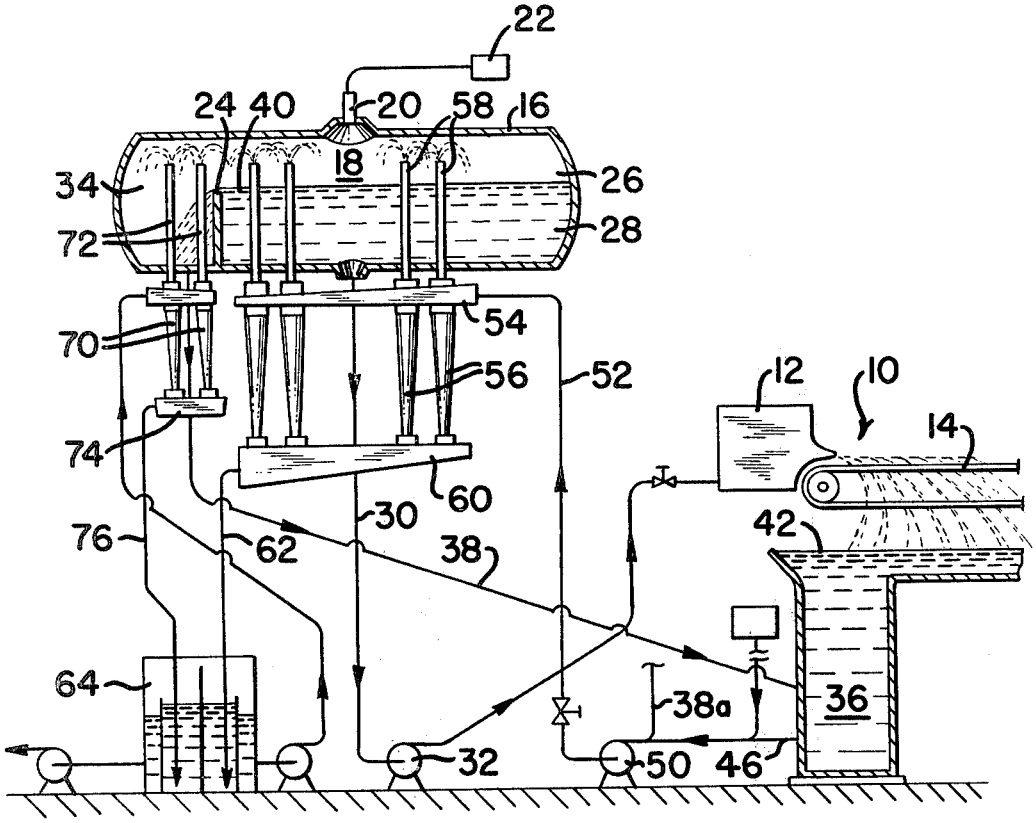
FIG. 1 is a schematic representation with some parts being shown in section and broken away of a papermaking apparatus embodying the improvements in the barometric dropleg conduit means which is employed for returning overflow from a pond of papermaking suspension maintained within an elevated receiver to the wire pit under the papermaking machine.

Turning now to the papermaking system depicted in FIG. 1, it includes a papermaking machine shown generally at 10, to the head box 12 of which cleaned and deaerated papermaking stock is delivered and from whence such cleaned and deaerated paper-making stock issues onto the web forming means or wire 14 of the machine. The system also includes a stock receiver 16 which is a hollow structure of suitable size and shape being, by way of example, elongated cylindrical. The stock receiver 16 has its interior headspace 18 connected by means of a pipe 20 with an evacuating means 22 for maintaining the chamber under a condition of vacuum sufficient to deaerate papermaking stock introduced into such chamber. The receiver is sub-divided by an overflow weir 24 into a right side compartment 26 in which is maintained a pond 28 of deaerated stock which is fed from the pond through a conduit 30 by means of pump unit 32 to the head box 12 of the paper machine 10. The stock overflowing the weir 24 from pond 28 flows as a cascade thereof into an overflow compartment 34 at the left side of the receiver and which compartment is connected for outflow of papermaking stock therefrom to a wire pit or silo 36 or, alternatively, as by branch line 38*a* to the suction side of pump 50 by a dropleg conduit 38, such dropleg conduit means 38 being a barometric dropleg component. As those skilled in the art will understand, the receiver 16 is elevated some distance above the wire pit 36 so that the level 40 of the overflow from weir 24 would be, e.g., at sea level at least 34 feet above the level 42 in the wire pit or silo. Dilution water can be taken from the silo through line 46 to be used for diluting the feed to the receiver. Additionally, dilution water can be drawn from the wire pit through a line (not shown) for delivery to a subsequent cleaning stage. The overflow level of the weir, would if the last-mentioned addition dilution feature was used then be at a greater height above the level of the liquid in the silo as for example being as much as 42 or more feet above the silo level.

The dilution water taken from the silo (which could include thick stock) is fed through pump 50 line 52 and into the feed manifold 54 of a primary cleaning stage and from thence through centrifugal cleaner units 56, and by means of inlet pipes 58 extending above the level of the pond 28 in the receiver 16 accepted or cleaned papermaking suspension is sprayingly introduced into the receiver, with rejects from the primary stage cleaners 56 outletting through manifold 60 and conduit 62 to a seal box 64.

Secondary stage cleaners 70 may also be employed with the accepts therefrom issuing from inlet pipes 72 into the receiver at the overflow side of the weir and constituting an additional inflow to the chamber at the left side of the weir in addition to that liquid overflowing the the weir from the pond. Rejects from the second stage cleaners 70 are delivered to rejects manifold 74 and by means of conduit 76 are delivered to the seal box 64. A subsequent stage of cleaning can then draw from the seal box.

It will be understood that in connection with the operation of the above-mentioned apparatus, the condition of vacuum present in the stock receiver which acts on both the head space above the pond 28 as well as in the head space of the overflow chamber 34, and the operating temperature of the papermaking suspension will cause to be exerted a suction lift in the dropleg conduit 38 which will maintain a level of liquid in such dropleg conduit at a certain distance above the level of the wire pit or silo 42. For a given condition of vacuum (e.g., at sea level), this level will change depending on the temperature of the stock so that for stock at 100° temperature, the level above the wire pit would be approximately 32 feet whereas with a stock temperature of 140°, the level would be approximately 27 feet above the wire pit level.

In accordance with the present invention, at least an upper length portion of the dropleg conduit 38 is designed to eliminate any likelihood of creation of pulsations or vibrations as might exist in the dropleg conduit means 38 since, as will be noted, the stock overflowing the weir if allowed to drop directly into a large pipe conduit at the bottom of chamber 34 would enter therein in a cascade or free-fall condition which when striking the vacuum induced suction lift level in the dropleg conduit could create pulsations, vibrations and the like which desirably should be avoided so as to enhance and allow for optimized overall system operation. The present invention overcomes the foregoing problems by employment in at least an upper length portion of the dropleg conduit of a plurality of pipes which define a plurality of outflow courses at the said upper end of the dropleg conduit and for which purpose reference will be made next to FIGS. 2–5.

Figure 2:
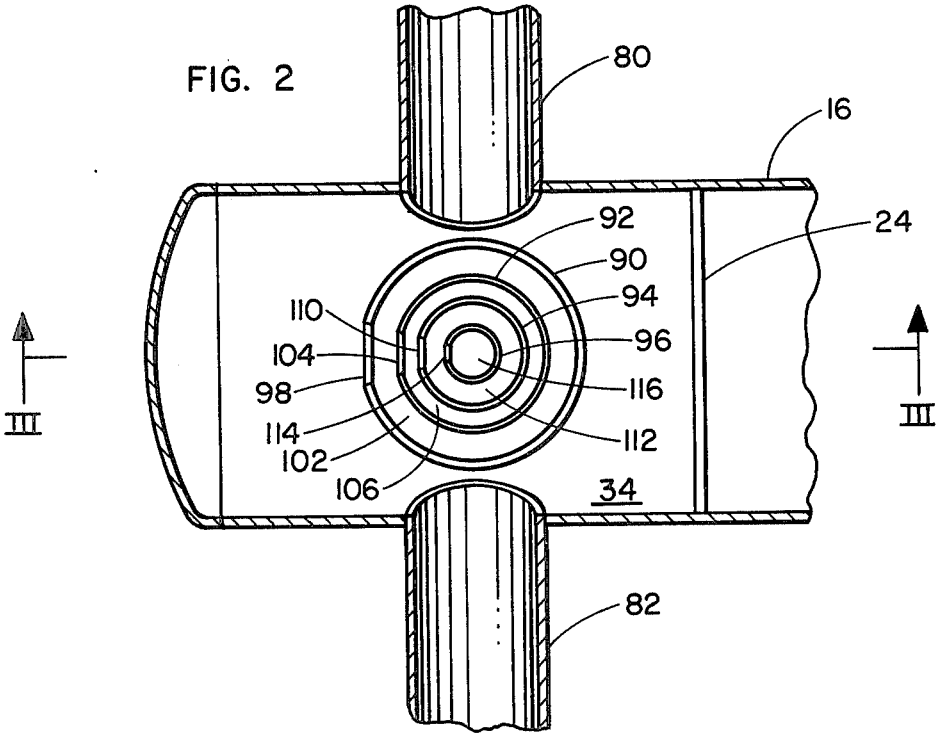
FIG. 2 is a plan view in section of a stock receiver embodying the present invention in the overflow compartment therein, there being shown connected to said overflow compartment a pair of receiver wings of the type described in U.S. Pat. No. 3,538,680.
Figure 3:
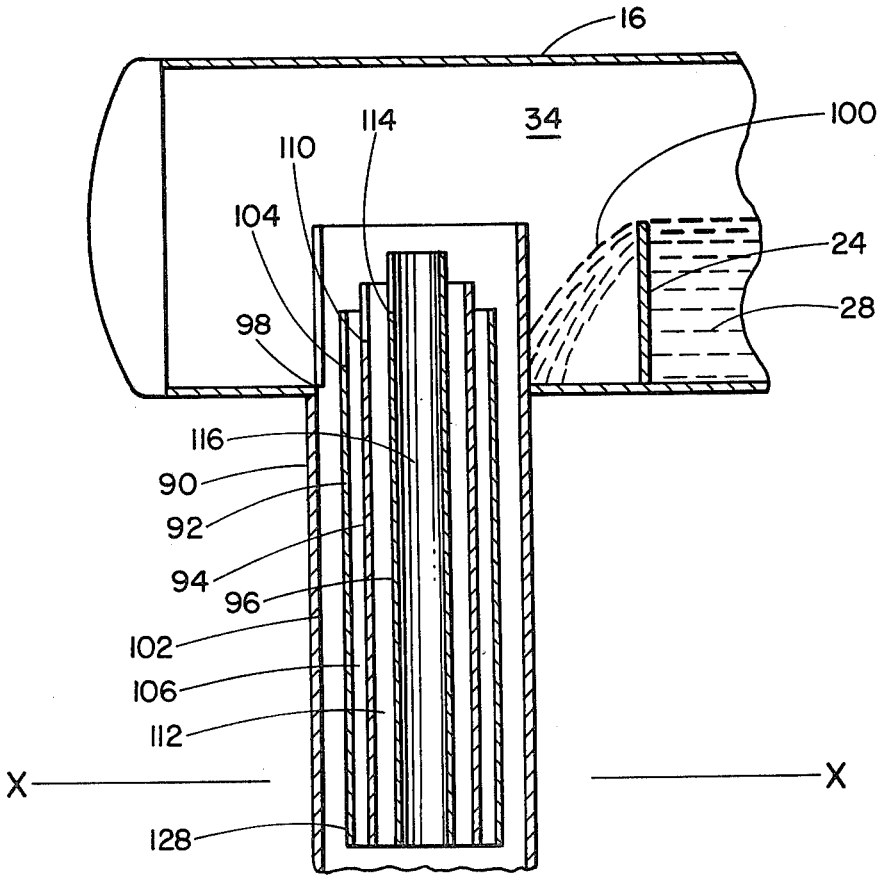
FIG. 3 is a sectional view taken along the lines III—III in FIG. 2, the wing receiver connection to the overflow compartment shell being omitted for sake of clarity.

With reference to FIG. 2, the same depicts an overflow compartment 34 to which papermaking suspension is overflowing weir 24 from a ponded level in a receiver 16, the same, for example, being depicted also in commonly owned U.S. Pat. No. 3,206,917. There is also shown in this figure, a pair of wing receivers 80, 82 of the type described more fully in U.S. Pat. No. 3,538,680 and which also discharge a certain inflow to chamber 34. The plurality of outflow courses is defined by pipes 90, 92, 94 and 96 which in the FIG. 2 and FIG. 3 embodiment are arranged as a concentric array of pipes so that each pipe and an adjacent pipe define an annular outflow course through the dropleg conduit except for the centermost pipe which exists as an outflow course without necessity for cooperation with one of the other pipes.

As will be noted, the pipes 90, 92, 94 and 96 are arranged such that they have different flow entry levels thereto within the receiver chamber 34. Thus the outermost pipe 90 in the concentric array and which is of the greatest height has the lowest point of flow entry of this grouping of pipes, flow entry thereto being at the bottom of the receiver as at 98, the pipe being appropriately notched or otherwise provided with an opening in its side wall structure to permit such flow entry. Overflow 100 at weir 24 cascades down into chamber 34 and strikes against the opposite side of the pipe (adjacent the weir) and which is higher than the expected cascade flow so that such liquid is caused to flow around the circular barrier presented by pipe 90 before it finds access at the side remote from the weir and as at 98. The sizing of the respective pipes 90, 92, 94 and 96 will of course be made dependent upon the operating parameters of the system. Thus, when a system condition changes to increase the overflow at the weir, and while such flow is received in the outflow course 102 defined by pipes 90 and 92, such pipe will accept as much flow as it can and run full but if the overflow increases, the level will rise in outflow course 102 until the same reaches the flow entry point of pipe 92 as at 104 so that flow will now continue in the annular outflow course defined between pipes 92 and 94. Flow will then continue through outflow course 106 until the same is filled and neither it nor outflow course 102 can handle the overflow from the weir and/or the wing chambers and the level will rise to bring the liquid at the point where it will have access to the flow entry point 110 to pipe 94 and hence outflow through outflow course 112. Again this will continue until finally overflow reaches the point 114 in pipe 96 and outflow will then pass through the outflow course 116 of pipe 96.

By employing this plurality of outflow courses 102, 106, 112 and 116, it is believed, although I do not wish to be bound by any particular theory in this regard, that the backing up of the level in the respective outflow courses until a particular one runs substantially full before flow commences in the next will decrease any pulsation or vibration effect that would be created by the free fall of substantial quantities of liquid into the dropleg conduit wherein such cascading fall would strike or impinge upon the suction lifted level to produce such pulsations, the unfilled and any only partially filed outflow courses in this respect functioning as absorption chambers for the pulsations.

Figure 6:
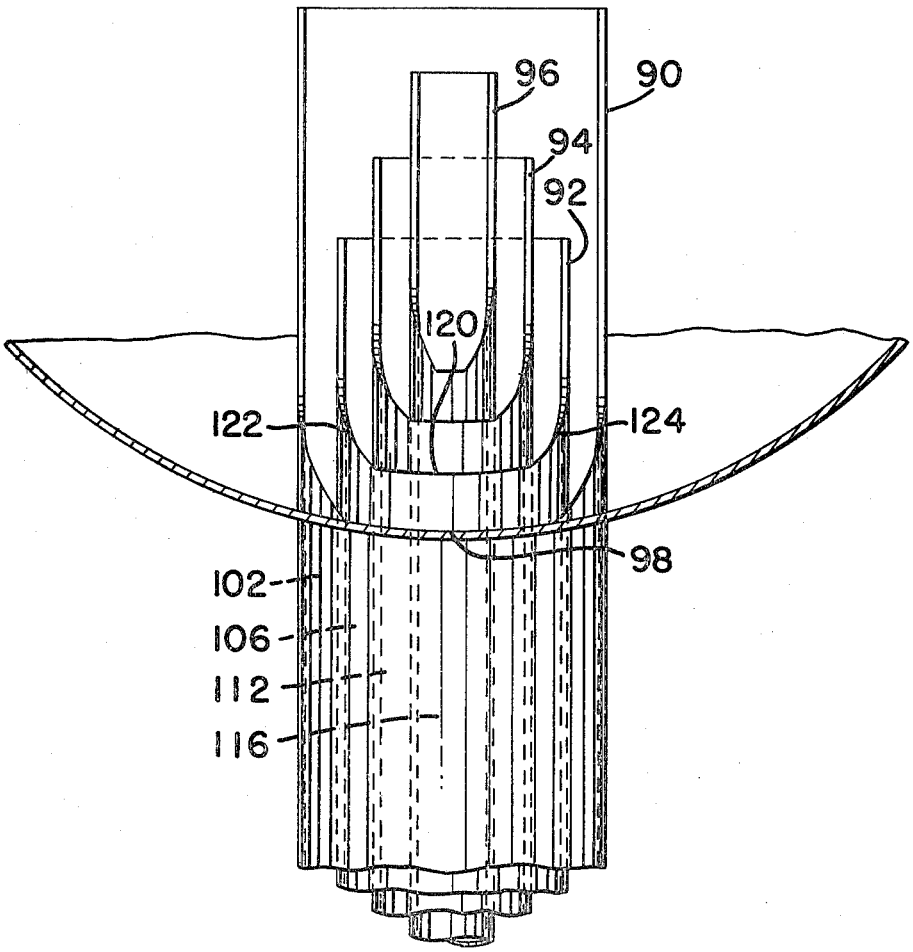
FIG. 6 is an elevational view of the entrance side of a plurality of pipes forming the upper portion of the dropleg conduit means and in particular depicting the notch configuration formed therein for defining the respective flow entry levels in the pipes.

FIG. 6 shows one manner in which the heights of the flow entry levels of the respective pipes 90, 92, 94 and 96 can be achieved. Thus, the outermost pipe 90 in the concentric ring will have entry thereto at the bottom of the receiver as at 98. On the other hand, pipe 92 having the next highest level can be provided with a notched or scarfed opening in its wall structure including a base such as 120 which defines the flow entry level and upwardly outwardly tapering sides 122, 124 which together with the base define a notch-like opening in the pipe, the same type of notches being provided for the remaining pipes.

In conjunction with the employment of wing receivers 80 and 82 as shown in FIG. 2, it will be noted that by placing the flow entry access (notches or the like) along a common side of the plurality of pipes, the flow entry is positioned relatively remotely to the point at which flow of liquid enters the chamber 34.

Turning again to FIG. 3, it will be seen that each of the respective pipes 90, 92, 94 and 96 has a lower end as at 128 which is positioned at least some distance below the level X—X of the vacuum suction lifted level in the dropleg conduit, such level X—X being the minimum level at which the system would operate, for example, being the level at which the system was operating with a stock temperature of 140°.

Figure 4:
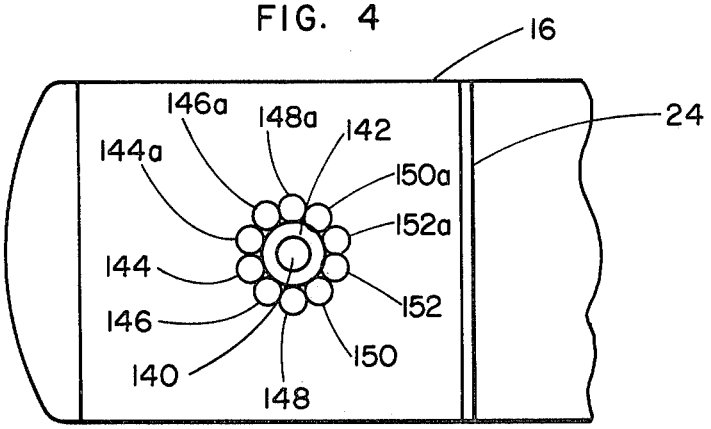
FIG. 4 is a schematic plan depiction of an overflow compartment in a receiver embodying an alternative form of dropleg conduit means.
Figure 5:
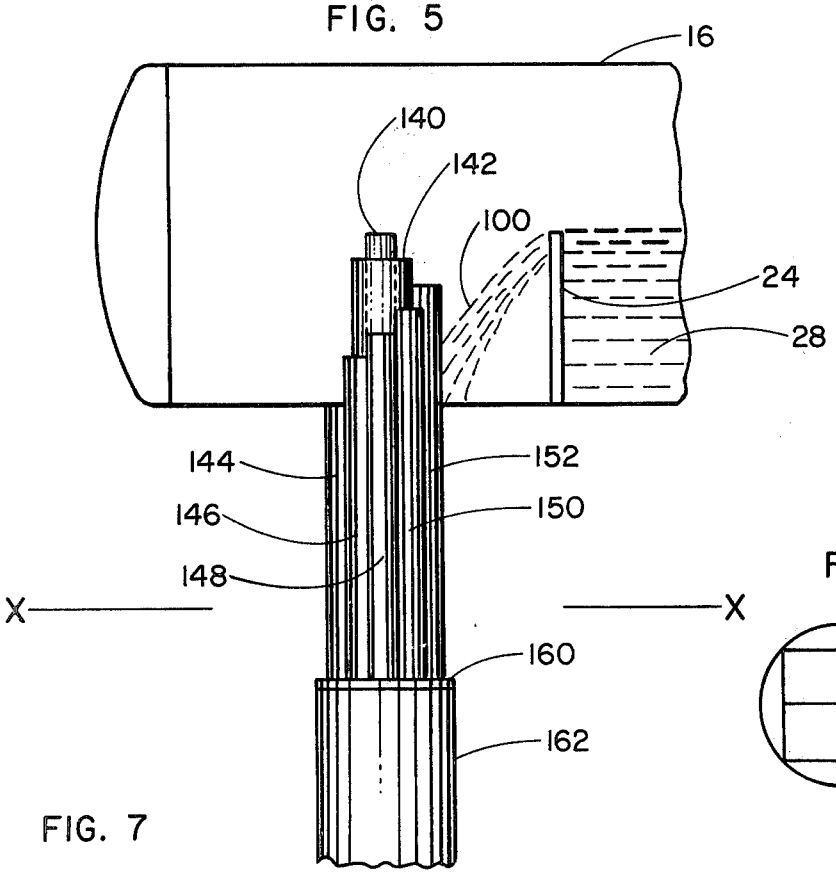
FIG. 5 is an elevational view of the apparatus shown in FIG. 4 depicting the varying levels of elevation of the flow entrance locations of the respective pipes in the plurality constituting the upper length section of the dropleg conduit means.

FIGS. 4 and 5 show an alternative arrangement of the plurality of pipes which are disposed in the upper section length of the dropleg conduit means. Thus, it will be noted that the plurality includes a centermost pipe 140 which is the highest pipe in the cluster, a second encircling centrally disposed pipe 142 which is next highest in the cluster, and then a series of pipes arranged in a circular spaced array about two central pipes.

These pipes would include two pipes 144 and 144*a* having entry thereto at a level at the bottom of the receiver. The next two highest pipes 146 and 146*a* would receive flow after pipes 144 and 144*a* are filled. The next highest pipes would be pipes 148 and 148*a* followed by pipes 150 and 150*a* and finally the last two pipes in the circular array 152 and 152*a* and after which such pipes are filled flow would enter pipe 142 and finally the centermost pipe 140 as the inflow to the compartment increased. As is shown in FIG. 5, the cluster of pipes can be supported in various manners for example being joined together by a plate-like connector piece 160 and their bottom ends and the dropleg conduit may then have transition into a single pipe structure 162 continuing down to the wire pit. As will be noted in FIGS. 4 and 5, the plurality of pipes can have for example a circular cross-section. Also, it will be noted that flow entry levels of these pipes are defined by the upper edges of each.

Figure 9:
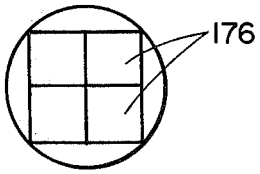
FIG. 9 is a top plan view depicting the employment of pipes of rectangular section.
Figure 7:
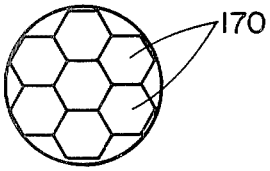
FIG. 7 is a top view of another arrangement of pipes in which the plurality of same are of hexagonal cross-section.
Figure 8:
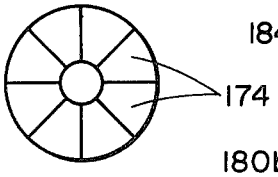
FIG. 8 is a view similar to FIG. 7 except the clustered together pipes are comprised of a centermost pipe surrounded by a circularly arranged array of wedge-shaped pipes.

FIGS. 7–9 show other configurations of cross-section of pipes which could be employed in the cluster. Thus the pipes 170 which are held together in clustered formation by connector plate 172 could be of hexagonal cross-section. FIG. 8 shows that the centermost part of the cluster could be circular and could be surrounded by a circular array of wedge-shaped pipes 174. FIG. 9, on the other hand, depicts the employment of rectangular cross-section pipes 176.

Figure 10:
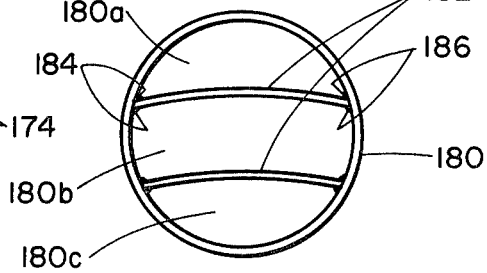
FIG. 10 is a top plan view of an upper length portion of the dropleg conduit means wherein a single pipe is employed for providing a plurality of outflow courses by means of sector plates disposed inside the pipe and extending from opposite sides thereof to divide the pipe cross-section into three separate outflow courses.

As an illustration of the various manners and ways in which the plurality of outflow courses can be provided for and defined within the upper length section of the dropleg conduit, the same could be formed as depicted in FIG. 10 from a single pipe 180 which is fitted on the inside with one or more divider plate components 182 welded to the inner wall surfaces of the pipe 180 at opposite locations as at 184 and 186 and thus dividing the pipe 180 into three separate outflow courses 180*a*, 180*b* and 180*c*.

Figure 11:
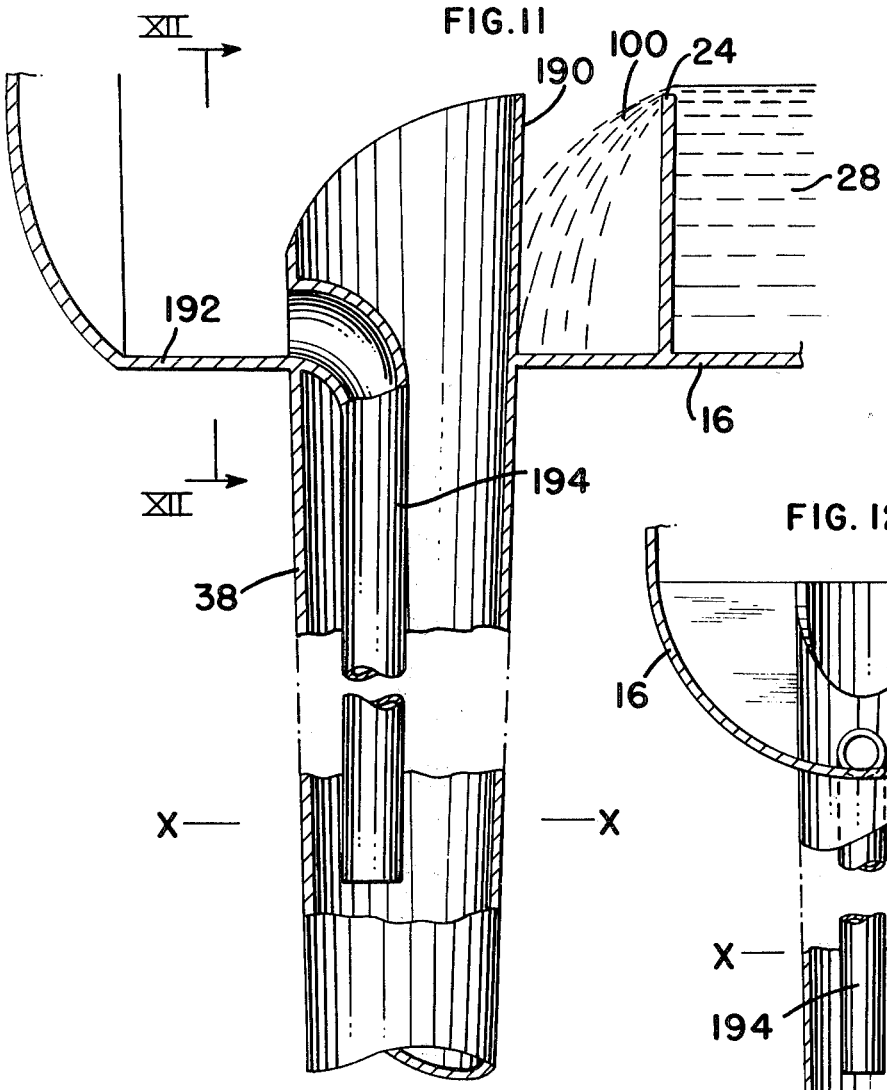
FIGS. 11 and 12 are respectively side and end elevational views partly in section and with parts broken away of another embodiment of dropleg conduit means such embodiment being particularly adapted for field modification of existing apparatus.
Figure 12:
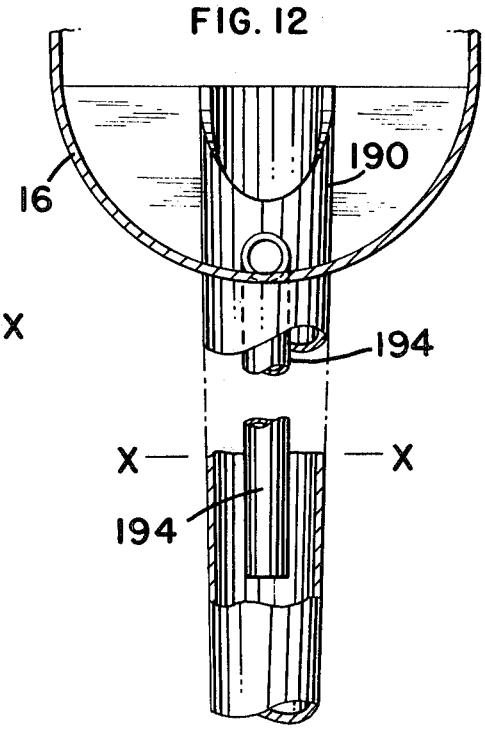

It will be understood that the present invention has applicability not only to new construction systems but it is also readily adaptable to existing systems. One form of modification which could be effected to existing systems is that depicted in FIGS. 11 and 12 wherein an existing dropleg conduit 38 could be modified as its upper section by installation of an extension piece 190 which extension piece will be noted rises up to the level of the overflow from the weir 24 and has a scarfed or downwardly tapering top edge which terminates a short distance above the bottom 192 of the receiver 16, there also being provided a second pipe 194 having flow entry at the bottom of the receiver and which is extended downwardly a distance in the main existing dropleg conduit section 38 until its lower end extends below the minimum suction lift level X—X. Installation of the pipe 194 can readily be effected in the field along with the extension piece 190 to thereby modify an existing receiver unit.

Another form of providing a plurality of outflow courses is the structure depicted in FIGS. 13 and 14 from whence it will be noted that the outflow courses are defined by a plurality of pipes 200, 202 and 204 which it will be noted taper inwardly and downwardly so as to constrict or reduce the cross-sectional area of the respective outflow courses down toward and below the minimum suction level X—X. The outermost pipe 200 extends some distance above the bottom of the receiver 16 but has entry at the lowest level of the three pipes, such entry being at the bottom of the receiver and as shown in FIG. 14 being an open side formed in the pipe at the side thereof remote from the weir 24. The next higher overflow level is that defined by the top of pipe 202 and finally the last overflow level is that defined by the top of pipe 294 (the latter being the innermost one in the cluster of three concentrically arranged pipes). Pipe 200 also is fitted with a number of drain openings 206.

As has been indicated above, and if it is desirable to effect a certain control of the flow velocity of the liquid passing through the respective pipes and for such purpose, these pipes are tapered from top to bottom for at least a portion of their length. One such arrangement is that shown in FIGS. 15, 15*a* and 15*b* wherein the pipes 222, 224, 226 and 228 from their connector piece 220 disposed at the receiver taper downwardly to a smaller cross-sectional area at the connector piece 230 from whence said pipes enter into a single enlarged dropleg conduit lower length portion area 232. The manner of decrease of effective cross-sectional area can further be seen from comparison of FIGS. 15*a* and 15*b*. Those skilled in the art will readily appreciate that the pipes need not be tapered for their full lengths but could be in part straight and then followed by tapered sections.

Figure 16:
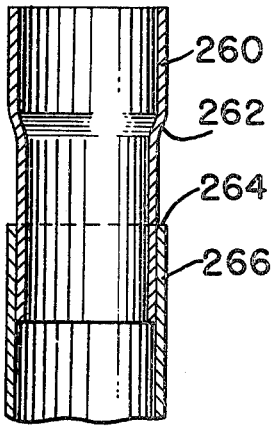
FIGS. 16 and 17 depict in elevational sectional view various forms of extension pieces which can be fitted to the tops of the pipes to extend the effective flow entry heights of the same.
Figure 17:
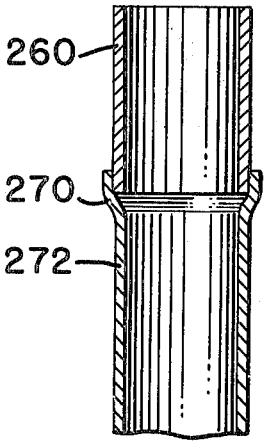

FIGS. 16 and 17 show the manner in which extension pieces 260 can be added to the tops of the respective plurality of pipes to increase the effective heights at which overflow entry would occur thereto. Thus it will be seen as for example in FIG. 16 an extension piece 260 can be provided with an enlarged mid-body segment 262 which will fit on the top 264 of the pipe 266. On the other hand, as shown in FIG. 17, a belled upper end 270 could be formed on the pipe 272 for reception of the extension piece 260.

While there is disclosed above only certain embodiments of the improvements in apparatus and method of the present invention, it will be apparent that various modifications could be made in the same without departing from the scope of the inventive concept herein disclosed.

What is claimed is:

1. An apparatus for collecting a liquid at one location and conveying said liquid to a second point of use location, said one location being disposed a distance above said second location, said apparatus comprising a receiver, means for introducing an inflow of liquid to said receiver and at a rate at which there is always a head space in said receiver above the liquid therein, means for maintaining the head space in said receiver under a condition of vacuum sufficient to deaerate the liquid introduced in said receiver, and barometric dropleg conduit means connecting said receiver to said point of use for conveying at least a portion of the liquid inflow to the receiver to said point of use, the condition of vacuum in said receiver and temperature of the liquid being such as to effect vacuum lift on said liquid in the dropleg conduit means and therewith maintain a level of said liquid in said dropleg conduit means a certain distance above said point of use, the improvement wherein at least an upper portion length of said barometric dropleg conduit means comprises a plurality of outflow pipes extending upwardly within said receiver a distance from the bottom thereof, flow entry to at least some of said pipes being at different heights above said receiver bottom than it is for others of said pipes, each outflow pipe extending downwardly from said receiver for a predetermined distance and having a lower terminal end which is positioned below the minimum vacuum lift level of liquid maintained in said dropleg conduit means.

2. The apparatus of claim 1 in which at least one outflow pipe in the plurality has flow entry thereto at the bottom of the receiver, each remaining outflow pipe in the plurality having flow entry thereto at a height above the bottom of the receiver which is different than the flow entry height of at least some of the others of the outflow pipes in said remainder of the plurality.

3. The apparatus of claim 2 in which each remaining outflow pipe in the plurality has flow entry thereto at a height above the bottom of the receiver which is different than the flow entry height of any of the others in said remainder of the plurality.

4. The apparatus of claim 2 in which said plurality of outflow pipes are disposed in a concentrically arranged array of such pipes.

5. The apparatus of claim 4 in which flow entry to said outflow pipes is along a common side area of each.

6. The apparatus of claim 5 in which flow entry to said pipe is defined by entry notches formed in the wall structure of said pipes along said common side area.

7. The apparatus of claim 6 in which each entry notch includes a base defining the flow entry height for the associated pipe and side margins extending upwardly from said base.

8. The apparatus of claim 7 in which said notch side margins extend outwardly upwardly relatively of the notch base.

9. The apparatus of claim 4 in which said pipes at least from the locations thereof at the bottom of said receiver taper inwardly toward the lower terminal ends thereof.

10. The apparatus of claim 9 in which at least each encircled pipe and the pipe encircling same defines an outflow course and the tapers of each are arranged to provide a reducing outflow course area in the direction of the lower terminal ends of said pipes, whereby a flow velocity change is produced in the liquid flowing in said outflow courses.

11. The apparatus of claim 2 in which said plurality of pipes is arranged in a central, closely positioned together cluster of such pipes.

12. The apparatus of claim 11 in which said pipes are of circular cross-section.

13. The apparatus of claim 11 in which said pipes are of polygonal cross-section.

14. The apparatus of claim 13 in which the polygon is a hexagon.

15. The apparatus of claim 13 in which the polygon is a rectangle.

16. The apparatus of claim 11 in which said cluster includes a centrally located pipe, and the remaining pipes arranged about said centrally located pipe in circular array.

17. The apparatus of claim 16 in which said centrally located pipe is of circular cross-section and said remaining pipes are of like cross-section.

18. The apparatus of claim 16 in which said centrally located pipe is of circular cross-section and said remaining pipes are of wedge-like cross-section.

19. The apparatus of claim 16 in which said centrally located pipe is of hexagonal cross-section and said remaining pipes are of like cross-section.

20. The apparatus of claim 2 in which said plurality of pipes is composed of a single pipe member and a plurality of pipe segments fitted within said pipe member and each spanning same from opposite sides so as to define a plurality of pipe courses within said pipe member.

21. The apparatus of claim 2 in which said plurality of pipes is comprised of a spaced apart arrayed arrangement of such pipes.

22. The apparatus of claim 1 in which the lower terminal ends of said outflow pipes extend at least twelve inches below the minimum vacuum lift level of liquid maintained in said dropleg conduit means.

23. The apparatus of claim 1 in which at least some of the pipes in said plurality are fitted at the tops thereof with means for removably receiving extension pieces to raise the flow entry heights thereof an additional distance above the bottom of the receiver.

24. The apparatus of claim 1 in which the liquid is a papermaking suspension, and the means for introducing such suspension into said receiver includes spray inlet pipes discharging suspension into the headspace of said receiver.

25. The apparatus of claim 24 in which said apparatus further comprises means for maintaining the suspension introduced into said receiver as a pond thereof, there further being a conduit connected with said receiver under said pond for delivery of suspension therefrom to a papermaking operation, suspension overflowing said pond outletting said receiver through said dropleg conduit means.

26. The apparatus of claim 25 in which the pond maintaining means is a weir in said receiver defining a suspension pond compartment and a suspension overflow compartment in said receiver.

27. The apparatus of claim 26 in which the plurality of pipes have flow entry notches formed therein at sides of the pipes which are remote from said weir.

28. The apparatus of claim 26 in which said plurality of outflow pipes is disposed in a concentrically arranged array of such pipes, at least a portion of said outermost pipe extending the top of said weir.

29. The apparatus of claim 2 in which each of said pipes from the point of flow entry thereto to the terminal end thereof are of diminishing cross-sectional area whereby a flow velocity change is produced in the liquid flowing in said pipes.

30. The apparatus of claim 4 in which the said one outflow pipe is the outermost one in the concentric array and is provided with drain holes at the level of said receiver bottom.

31. In a method for collecting a liquid at a first location and conveying said liquid to a second point of use location, said first location being disposed a distance above said second location, said method including introducing an inflow of liquid to said zone, subjecting the liquid while in said zone to a condition of vacuum sufficient to deaerate the liquid, and conveying the liquid through a barometer dropleg conduit means extending between said two locations, the condition of vacuum in said zone and the temperature of the liquid being such as to effect vacuum lift on said liquid in the dropleg conduit means and therewith maintain a level of said liquid in said dropleg conduit means a certain distance above said point of use, the improvement of establishing in at least an upper length portion of said dropleg conduit means a plurality of separate outflow courses which each extend downwardly a distance below the minimum vacuum lift level of liquid maintained in said dropleg conduit means, while maintaining the flow entry to the respective outflow courses at different levels of elevation so that flow through an outflow course can occur only subsequent to the filling of outflow courses having flow entry levels below that of said first-mentioned outflow course.

32. The method of claim 31 further comprising constricting the lower end parts of said outflow courses to change the flow velocity of the liquid in said outflow courses.

33. The method of claim 31 further comprising establishing the entry to said outflow courses at locations remote from the point of entry of liquid inflow to said zone.

34. The method of claim 31 in which the liquid is a papermaking suspension and further comprising maintaining a pond of such suspension in a zone communicating with said collection location, suspension overflowing said pond passing from said zone to said first location.

* * * * *